US010422146B2

(12) United States Patent
Shima et al.

(10) Patent No.: US 10,422,146 B2
(45) Date of Patent: Sep. 24, 2019

(54) REBAR TYING DEVICE

(71) Applicant: MAKITA CORPORATION, Anjo-shi, Aichi (JP)

(72) Inventors: Kunihisa Shima, Anjo (JP); Hirokatsu Yamamoto, Anjo (JP); Ryo Umemoto, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 0 days.

(21) Appl. No.: 15/742,573

(22) PCT Filed: Mar. 11, 2016

(86) PCT No.: PCT/JP2016/057872
§ 371 (c)(1),
(2) Date: Jan. 8, 2018

(87) PCT Pub. No.: WO2017/010121
PCT Pub. Date: Jan. 19, 2017

(65) Prior Publication Data

US 2018/0202178 A1 Jul. 19, 2018

(30) Foreign Application Priority Data

Jul. 13, 2015 (JP) ..... 2015-139925

(51) Int. Cl.
*E04G 21/12* (2006.01)
*B21F 15/00* (2006.01)
(Continued)

(52) U.S. Cl.
CPC ..... *E04G 21/123* (2013.01); *B21F 15/06* (2013.01); *B25B 25/00* (2013.01); *E04G 21/12* (2013.01)

(58) Field of Classification Search
CPC ..... B65B 13/025; B65B 13/027; B65B 13/28; B65B 13/285; B65B 13/22; B65H 59/04;
(Continued)

(56) References Cited

U.S. PATENT DOCUMENTS 5,874,816 A * 2/1999 Ishii ..... E04G 21/122 140/57
9,192,979 B2 * 11/2015 Itagaki ..... E04G 21/122
(Continued)

FOREIGN PATENT DOCUMENTS

JP 2006-027685 A 2/2006
JP 2010-001727 A 1/2010
JP 4548584 B2 9/2010

OTHER PUBLICATIONS

May 24, 2016 International Search Report issued in International Patent Application No. PCT/JP2016/057872.
(Continued)

*Primary Examiner* — Pradeep C Battula
(74) *Attorney, Agent, or Firm* — Oliff PLC

(57) ABSTRACT

A rebar tying device is configured to tie a plurality of rebars by a wire. The rebar tying device includes a feeder configured to feed the wire wound around a reel by a rotation of a feeding motor; a guide configured to guide the wire fed by the feeder to around the plurality of rebars; a cutter configured to cut the wire fed by the feeder at a predetermined position; a twister configured to twist the wire around the plurality of rebars; a battery configured to supply power to the feeding motor; and a control unit. The control unit configured to control a feeding length of the wire by controlling an energizing time of the feeding motor based on a predetermined feeding length of the wire.

15 Claims, 11 Drawing Sheets

(51) Int. Cl.
*B21F 15/06* (2006.01)
*B25B 25/00* (2006.01)

(58) Field of Classification Search
CPC .. B21F 9/02; B21F 15/00; B21F 15/02; B21F 15/04; B21F 23/00; B21F 23/005; B21F 33/00; E04G 21/122
See application file for complete search history.

(56) References Cited

U.S. PATENT DOCUMENTS

| | | | | |
|---|---|---|---|---|
| 9,856,041 | B2 * | 1/2018 | Itagaki | E04G 21/122 |
| 2007/0199610 | A1 | 8/2007 | Itagaki | |
| 2009/0283167 | A1 | 11/2009 | Nakagawa et al. | |
| 2009/0283172 | A1 * | 11/2009 | Itagaki | E04G 21/122<br>140/119 |
| 2011/0155277 | A1 * | 6/2011 | Coles | B65B 13/285<br>140/93.6 |
| 2014/0091171 | A1 | 4/2014 | Nakagawa et al. | |
| 2015/0232212 | A1 * | 8/2015 | Itagaki | E04G 21/122<br>100/8 |
| 2017/0130472 | A1 | 5/2017 | Nakagawa et al. | |
| 2017/0145704 | A1 * | 5/2017 | Coles | B65B 13/285 |

OTHER PUBLICATIONS

May 24, 2016 Written Opinion issued in International Patent Application No. PCT/JP2016/057872.

* cited by examiner

REBAR TYING DEVICE

TECHNICAL FIELD

The present invention relates to a rebar tying device.

BACKGROUND ART

Patent Literature 1 (Japanese Patent No. 4548584) discloses a rebar tying device configured to tie a plurality of rebars by a wire. The rebar tying device in Patent Literature 1 includes a feeder configured to feed the wire wound around a reel by a rotation of a motor, a guide configured to guide the wire fed by the feeder around the plurality of rebars, a cutter configured to cut the wire fed by the feeder at a predetermined position, a twister configured to twist the wire around the plurality of rebars, and a control unit. Moreover, the rebar tying device in Patent Literature 1 includes a detector configured to detect a feeding length of the wire fed by the feeder. The detector includes a plurality of magnets and a Hall element. In this rebar tying device, the control unit controls a feeding length of the wire based on the feeding length of the wire detected by the detector.

SUMMARY OF INVENTION

Technical Problem

The rebar tying device in Patent Literature 1 includes the detector in order to detect the feeding length of the wire, and the detector includes the plurality of magnets and the Hall element. Therefore, a position to arrange each of the plurality of magnets and wiring of the Hall element become complicated, for example, resulting in a complicated configuration of the rebar tying device. In other words, the detector for detecting the feeding length of the wire results in a complicated configuration of the rebar tying device. Accordingly, the present disclosure provides a technology capable of feeding a wire by an accurate length without detecting a feeding length of the wire.

Solution to Technical Problem

The rebar tying device disclosed herein may be configured to tie a plurality of rebars by a wire. The rebar tying device may comprise: a feeder configured to feed the wire wound around a reel by a rotation of a feeding motor, a guide configured to guide the wire fed by the feeder around the plurality of rebars; a cutter configured to cut the wire fed by the feeder at a predetermined position; a twister configured to twist the wire around the plurality of rebars; a battery configured to supply power to the feeding motor; and a control unit. The control unit may be configured to control a feeding length of the wire by controlling an energizing time of the feeding motor based on a predetermined feeding length of the wire.

According to such a configuration, the control unit can control the feeding length of the wire by controlling the energizing time of the motor, and even without using a separate detector to detect the feeding length of the wire. Moreover, since the control unit is configured to control the energizing time of the motor based on the predetermined feeding length of the wire, the wire can be fed by an accurate length.

DESCRIPTION OF EMBODIMENTS

Figure 1:
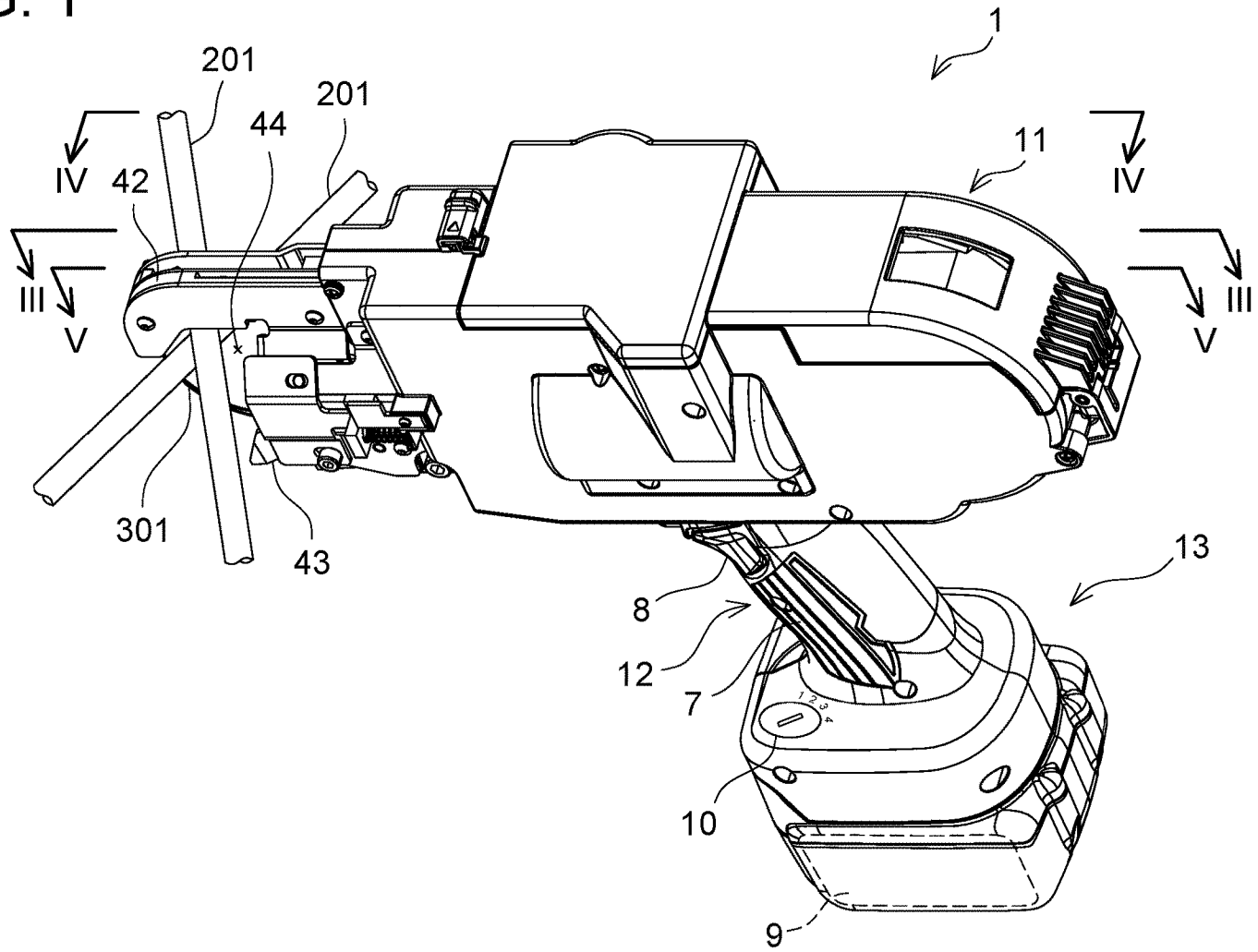
FIG. 1 is a perspective view of a rebar tying device according to a first embodiment.

The rebar tying device according to some embodiments may comprise a setter configured to set the feeding length of the wire. The energizing time of the feeding motor may be set based on the feeding length of the wire set by the setter.

According to the configuration described above, a user of the rebar tying device can set the feeding length of the wire to a desired feeding length.

In the rebar tying device according to some embodiments, the energizing time of the feeding motor may be set based on a state of the rebar tying device before the rotation of the feeding motor.

In the rebar tying device according to some embodiments, the energizing time of the feeding motor may be set based on an open voltage of the battery before the rotation of the feeding motor.

A speed of feeding the wire by the feeding motor varies with a remaining amount of the battery. A larger remaining amount of the battery causes larger power to be supplied to the feeding motor, and a higher speed of feeding the wire. The remaining amount of the battery can be estimated from the open voltage of the battery. The open voltage of the battery means a voltage between output terminals of the battery in a state where no load is connected to the output terminals. According to the configuration described above, since the energizing time of the feeding motor is set based on the open voltage of the battery, the energizing time of the feeding motor can be controlled accurately.

In the rebar tying device according to some embodiments, the energizing time of the feeding motor may be set based on the state of the rebar tying device during the rotation of the feeding motor.

In the rebar tying device according to some embodiments, the energizing time of the feeding motor may be set based on the state of the rebar tying device when the rotation of the feeding motor is stabilized.

In the rebar tying device according to some embodiments, the energizing time of the feeding motor may be set based on the state of the feeding motor during the rotation of the feeding motor.

In the rebar tying device according to some embodiments, the energizing time of the feeding motor may be set based on an induced voltage of the feeding motor during the rotation of the feeding motor.

The speed of feeding the wire by the feeding motor varies with the induced voltage of the feeding motor, and there is a relation in which a higher induced voltage of the feeding motor causes a higher speed of feeding the wire. Accordingly, if the induced voltage of the feeding motor is low, the speed of feeding the wire is low, and hence the energizing time of the feeding motor needs to be increased. In contrast to this, if the induced voltage of the feeding motor is high, the speed of feeding the wire is high, and hence the energizing time of the feeding motor needs to be decreased. According to the configuration described above, since the energizing time of the feeding motor is set based on the induced voltage of the feeding motor when the rotation of the feeding motor is stabilized, the energizing time of the feeding motor can be controlled accurately.

In the rebar tying device according to some embodiments, the energizing time of the feeding motor may be set based on a time integration value of a current of the feeding motor during the rotation of the feeding motor.

The speed of feeding the wire by the feeding motor varies with a remaining amount of the wire wound around the reel. A larger remaining amount of the wire wound around the reel causes a larger moment of inertia of the reel, and a lower speed of feeding the wire. The remaining amount of the wire wound around the reel can be estimated based on the time integration value of the current of the feeding motor from the start of the rotation of the feeding motor. According to the configuration described above, since the energizing time of the feeding motor is set based on the time integration value of the current of the feeding motor from the start of the rotation of the feeding motor, the energizing time of the feeding motor can be controlled accurately.

In the rebar tying device according to some embodiments, the energizing time of the feeding motor may be set based on a state of the battery during the rotation of the feeding motor.

In the rebar tying device according to some embodiments, the energizing time of the feeding motor may be set based on a time integration value of a voltage drop of the battery during the rotation of the feeding motor.

The remaining amount of the wire wound around the reel can also be estimated based on the time integration value of the voltage drop of the battery from the start of the rotation of the feeding motor. According to the configuration described above, since the energizing time of the feeding motor is set based on the time integration value of the voltage drop of the feeding motor from the start of the rotation of the feeding motor, the energizing time of the feeding motor can be controlled accurately.

In the rebar tying device according to some embodiments, the energizing time of the feeding motor may be set based on a voltage of the battery during the rotation of the feeding motor.

The speed of feeding the wire by the feeding motor varies with the remaining amount of the battery. A larger remaining amount of the battery causes larger power to be supplied to the feeding motor, and a higher speed of feeding the wire. The remaining amount of the battery can be estimated from the voltage of the battery when the rotation of the feeding motor is stabilized. According to the configuration described above, since the energizing time of the feeding motor is set based on the voltage of the battery when the rotation of the feeding motor is stabilized, the energizing time of the feeding motor can be controlled accurately.

In the rebar tying device according to some embodiments may comprise a current detector configured to detect a current of the feeding motor. The current detector and the control unit may be arranged on a same substrate.

In the rebar tying device according to some embodiments may comprise a voltage detector configured to detect a voltage of the battery. The voltage detector and the control unit may be arranged on a same substrate.

Whether or not the rotation of the feeding motor is stabilized can be determined based on whether or not the current of the feeding motor is stabilized. Alternatively, whether or not the rotation of the feeding motor is stabilized can be determined based on whether or not the voltage of the battery is stabilized. Alternatively, whether or not the rotation of the feeding motor is stabilized can be determined based on whether or not a predetermined time has elapsed from the start of the rotation of the feeding motor. In this case, the rotation of the feeding motor is stabilized after the predetermined time has elapsed.

First Embodiment

Figure 2:
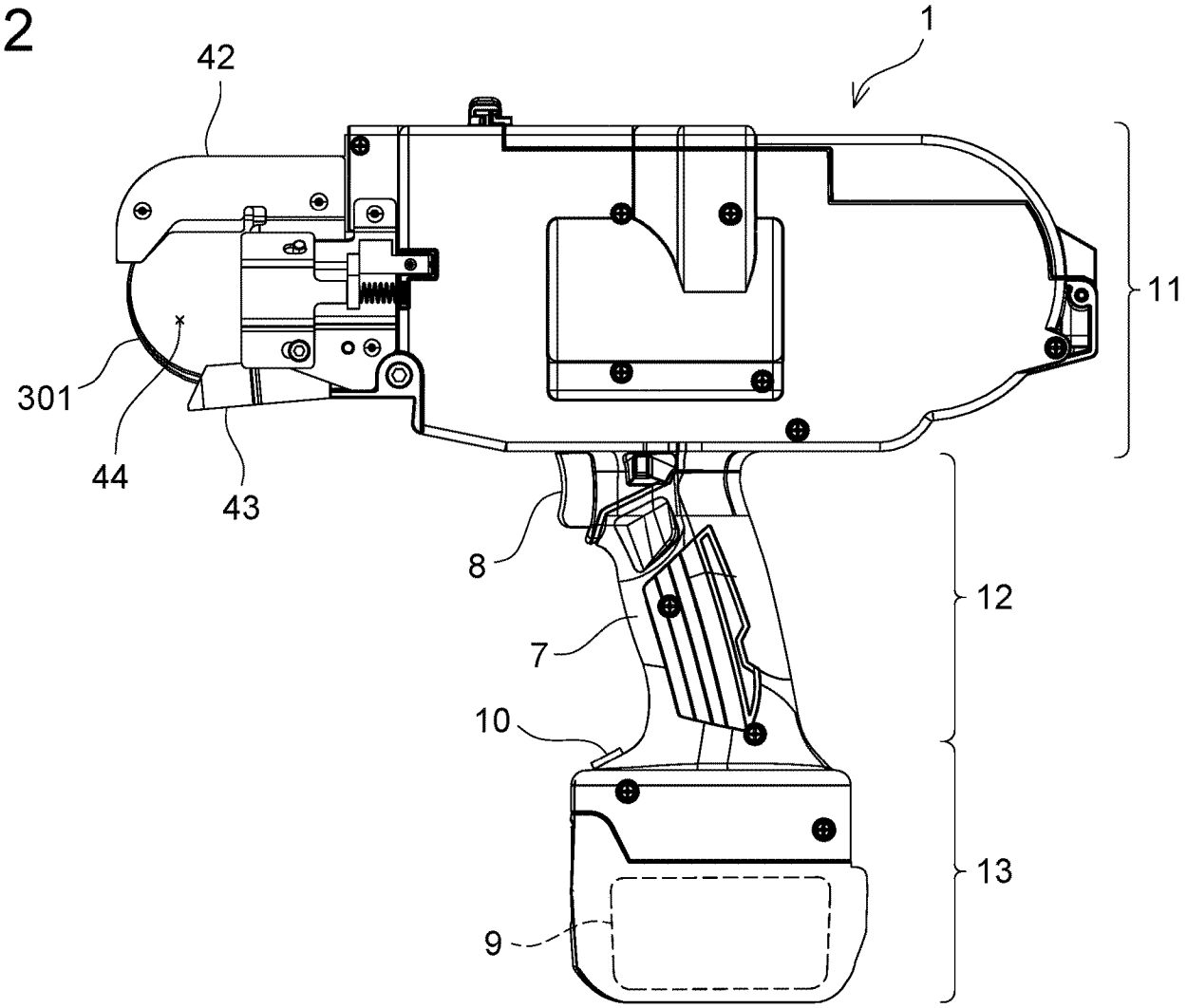
FIG. 2 is a side view of the rebar tying device according to the first embodiment.

A rebar tying device according to an embodiment will be described with reference to the drawings. As shown in FIGS. 1 and 2, a rebar tying device 1 includes a first unit 11, a second unit 12, and a third unit 13. The first unit 11, the second unit 12, and the third unit 13 are integrally formed. The rebar tying device 1 is an electrically-powered tool for tying a plurality of rebars 201 by a wire 301. Each of the rebars 201 is a bar steel used for manufacturing, for example, a rebar-reinforced concrete.

Figure 3:
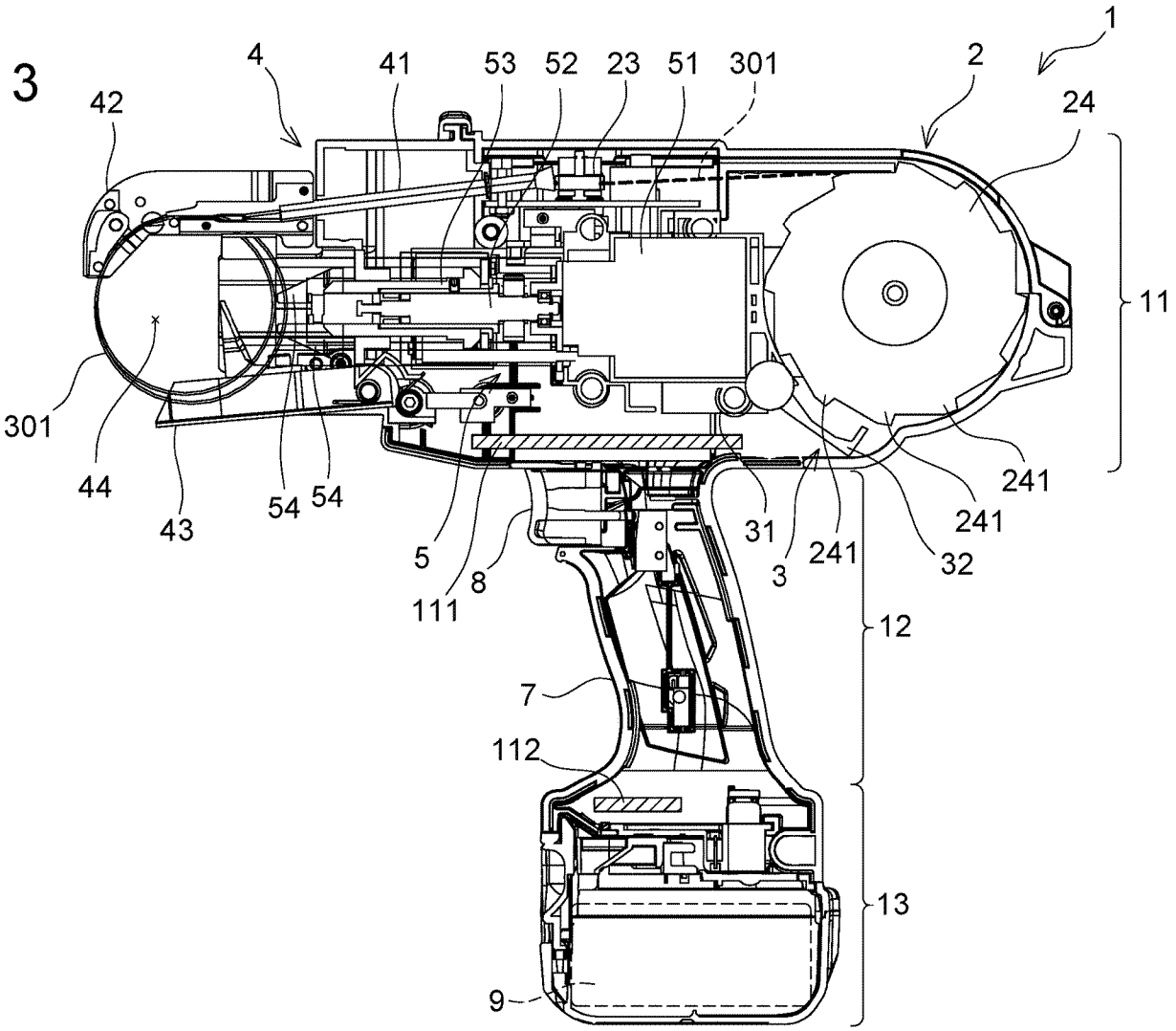
FIG. 3 is a diagram that schematically illustrates an internal configuration of the rebar tying device according to the first embodiment (and that corresponds to a section III-m in FIG. 1)
Figure 4:
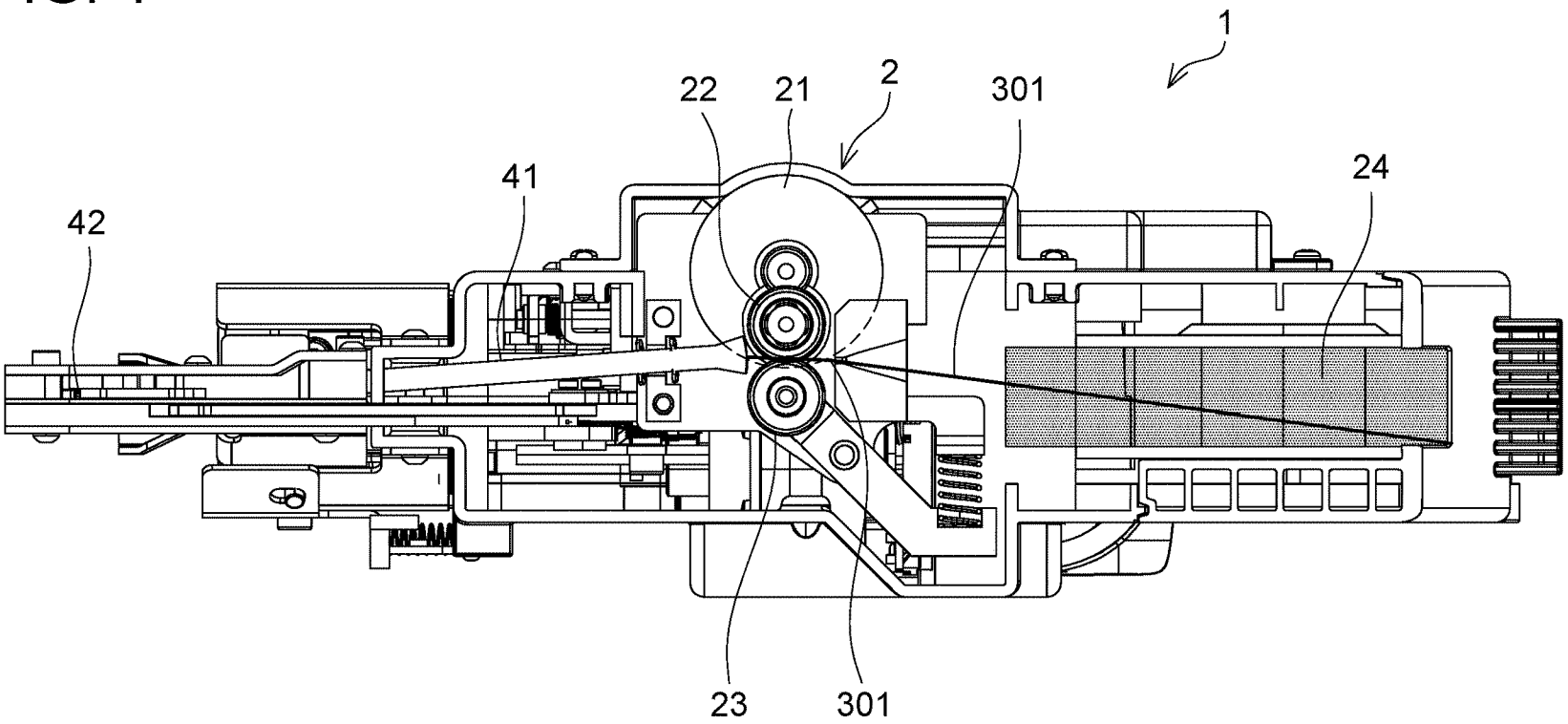
FIG. 4 is a diagram that schematically illustrates the internal configuration of the rebar tying device according to the first embodiment (and that corresponds to a section IV-IV in FIG. 1)
Figure 5:
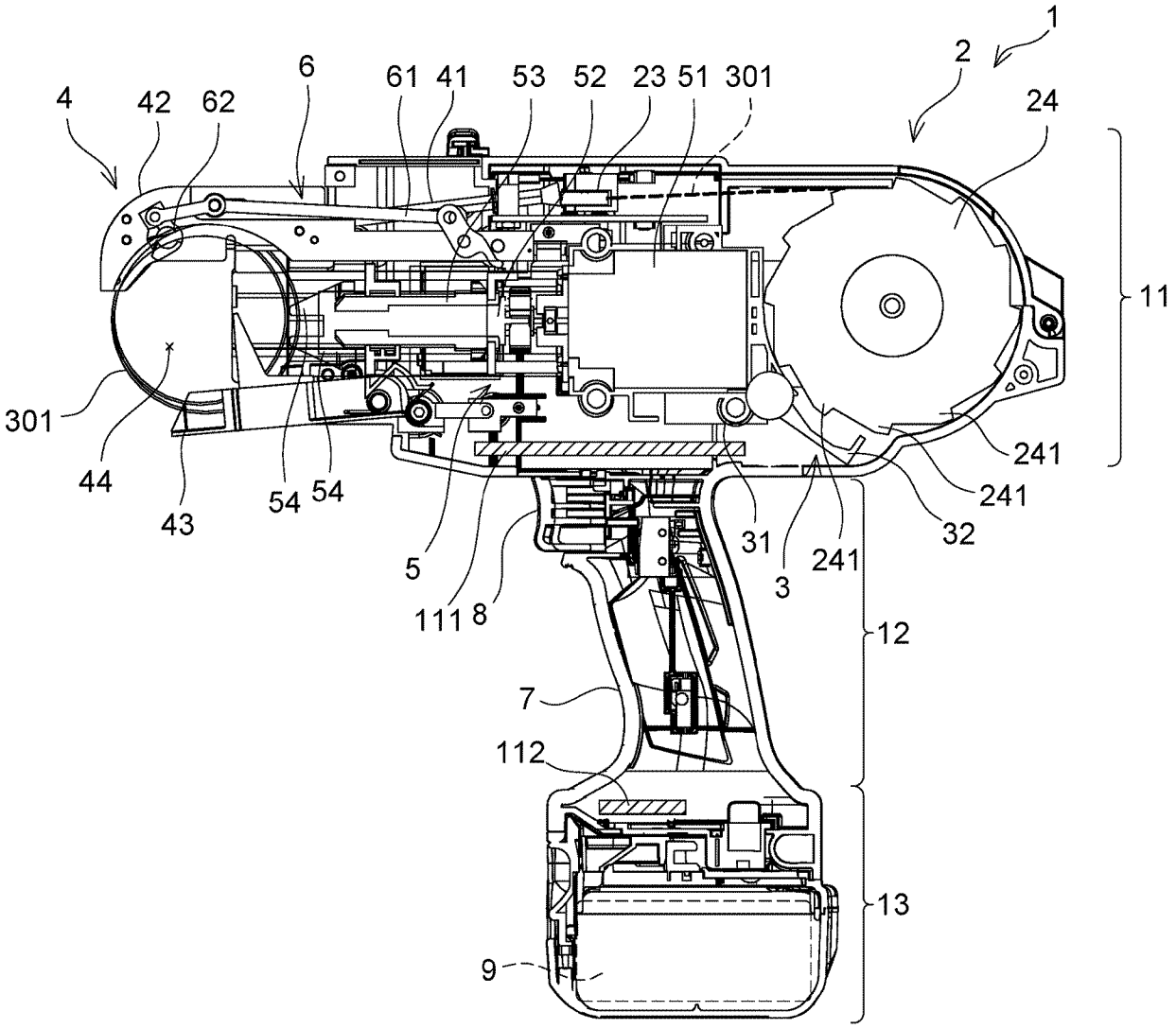
FIG. 5 is a diagram that schematically illustrates the internal configuration of the rebar tying device according to the first embodiment (and that corresponds to a section V-V in FIG. 1)

As shown in FIGS. 3 and 4, the first unit 11 includes a feeder 2, a rotation regulator 3, a guide 4, and a twister 5. Moreover, as shown in FIG. 5, the first unit 11 includes a cutter 6.

As shown in FIGS. 3 and 4, the feeder 2 includes a reel 24, a feeding motor 21, a driving roller 22, and a driven roller 23. The feeder 2 is a mechanism that feeds the wire 301 by a rotation of the feeding motor 21.

The reel 24 holds the wire 301. The wire 301 is wound around the reel 24. When the wire 301 is fed, the reel 24 rotates. The reel 24 includes a plurality of rotation-regulating protrusions 241. Each of the plurality of rotation-regulating protrusions 241 protrudes outwardly in a radial direction of the reel 24. The rotation-regulating protrusion 241 engages with a rotation-regulating arm 32 to be mentioned below.

The feeding motor 21 rotates by being energized. Moreover, the feeding motor 21 stops when energization is interrupted. When the feeding motor 21 rotates, the driving roller 22 rotates. The wire 301 is arranged between the driving roller 22 and the driven roller 23. When the driving roller 22 rotates, the wire 301 is fed, and concurrently, the driven roller 23 rotates. Moreover, the reel 24 rotates by the wire 301 being fed.

The rotation regulator 3 includes a solenoid 31 and the rotation-regulating arm 32. The rotation regulator 3 is a mechanism that regulates a rotation of the reel 24.

The solenoid 31 operates by being energized. When the solenoid 31 operates, the rotation-regulating arm 32 operates. When the solenoid 31 is operating, the rotation-regulating arm 32 engages with the rotation-regulating protrusion 241 of the reel 24. The rotation of the reel 24 is thereby regulated. On the other hand, when the solenoid 31 is not operating, the rotation-regulating arm 32 does not engage with the rotation-regulating protrusion 241 of the reel 24. Regulation of the rotation of the reel 24 is thereby released.

The guide 4 includes a guide pipe 41, an upper guide member 42, and a lower guide member 43. The guide 4 is a mechanism that guides the wire 301 fed by the feeder 2 to around the plurality of rebars 201.

The guide pipe 41 is arranged at a position facing the driving roller 22 and the driven roller 23. The guide pipe 41 guides the wire 301 fed from between the driving roller 22 and the driven roller 23 forward (in a left direction of the drawing).

The upper guide member 42 and the lower guide member 43 are arranged to face each other in a vertical direction. The upper guide member 42 is formed curvedly. The lower guide member 43 is formed linearly. A rebar arrangement region 44 is formed between the upper guide member 42 and the lower guide member 43. The plurality of rebars 201 is arranged in the rebar arrangement region 44. The upper guide member 42 and the lower guide member 43 guide the wire 301 guided by the guide pipe 41 around the plurality of rebars 201. The wire 301 is thereby wound around the plurality of rebars 201.

The twister 5 includes a twisting motor 51, a screw shaft 52, a screw tube 53, and a pair of hooks 54. The twister 5 is a mechanism that twists the wire 301 around the plurality of rebars 201.

The twisting motor 51 rotates by being energized. Moreover, the twisting motor 51 stops when energization is interrupted. When the twisting motor 51 rotates, the screw shaft 52 rotates. The screw shaft 52 is covered with the screw tube 53. The screw shaft 52 is threadedly engage with the screw tube 53. When the screw shaft 52 rotates, the screw tube 53 moves in an axial direction of the screw shaft 52. When the screw shaft 52 rotates in a normal direction, the screw tube 53 proceeds in the left direction of the drawing, and when the screw shaft 52 rotates in a reverse direction, the screw tube 53 retreats in a right direction of the drawing.

The pair of hooks 54 is coupled to the screw tube 53. The pair of hooks 54 proceeds when the screw tube 53 proceeds in the left direction of the drawing, and the pair of hooks 54 retreats when the screw tube 53 retreats in the right direction of the drawing. The pair of hooks 54 is configured to proceed and then be coupled to the screw shaft 52. When the screw shaft 52 rotates in a state where the pair of hooks 54 proceeds, the pair of hooks 54 rotates. Moreover, the pair of hooks 54 is configured to grasp the wire 301 when it proceeds. The pair of hooks 54 rotates while grasping the wire 301. A rotation of the pair of hooks 54 enables the wire 301 to be twisted.

As shown in FIG. 5, the cutter 6 includes a link mechanism 61 and a cutter portion 62. The cutter 6 is a mechanism that cuts the wire 301 fed by the feeder 2 at a predetermined position.

The link mechanism 61 is a mechanism that converts linear motion to rotational motion and transfers the rotational motion. One end portion of the link mechanism 61 is coupled to the screw tube 53. The other end portion of the link mechanism 61 is coupled to the cutter portion 62. The link mechanism 61 converts linear motion of the screw tube 53 to rotational motion, and transfers the rotational motion to the cutter portion 62. When the screw tube 53 proceeds in the left direction of the drawing, the cutter portion 62 rotates. The cutter portion 62 is configured to cut the wire 301 by rotating.

As shown in FIG. 2, the second unit 12 includes a grip 7 and a trigger 8. The grip 7 is a portion grasped by a user. The trigger 8 is arranged above the grip 7. A user depresses the trigger 8 while grasping the grip 7. The rebar tying device 1 is configured to operate when the trigger 8 is depressed.

The third unit 13 includes a battery 9 and a dial 10 (an example of the setter). The battery 9 supplies power to each of the feeding motor 21, the twisting motor 51, and the solenoid 31. The battery 9 is configured to be detachably attached.

The dial 10 is a configuration for setting a number of turns of the wire 301. A user can set the number of turns of the wire 301 by turning the dial 10. For example, if the number of turns of the wire 301 is to be set to two, the dial is tuned to "2". Moreover, when the number of turns of the wire 301 is set, a torque by which the wire 301 is twisted is set accordingly. Moreover, when the number of turns of the wire 301 is set, a feeding length of the wire 301 is determined accordingly. The dial 10 is arranged on a substrate 112. The substrate 112 is arranged above the battery 9.

Figure 6:
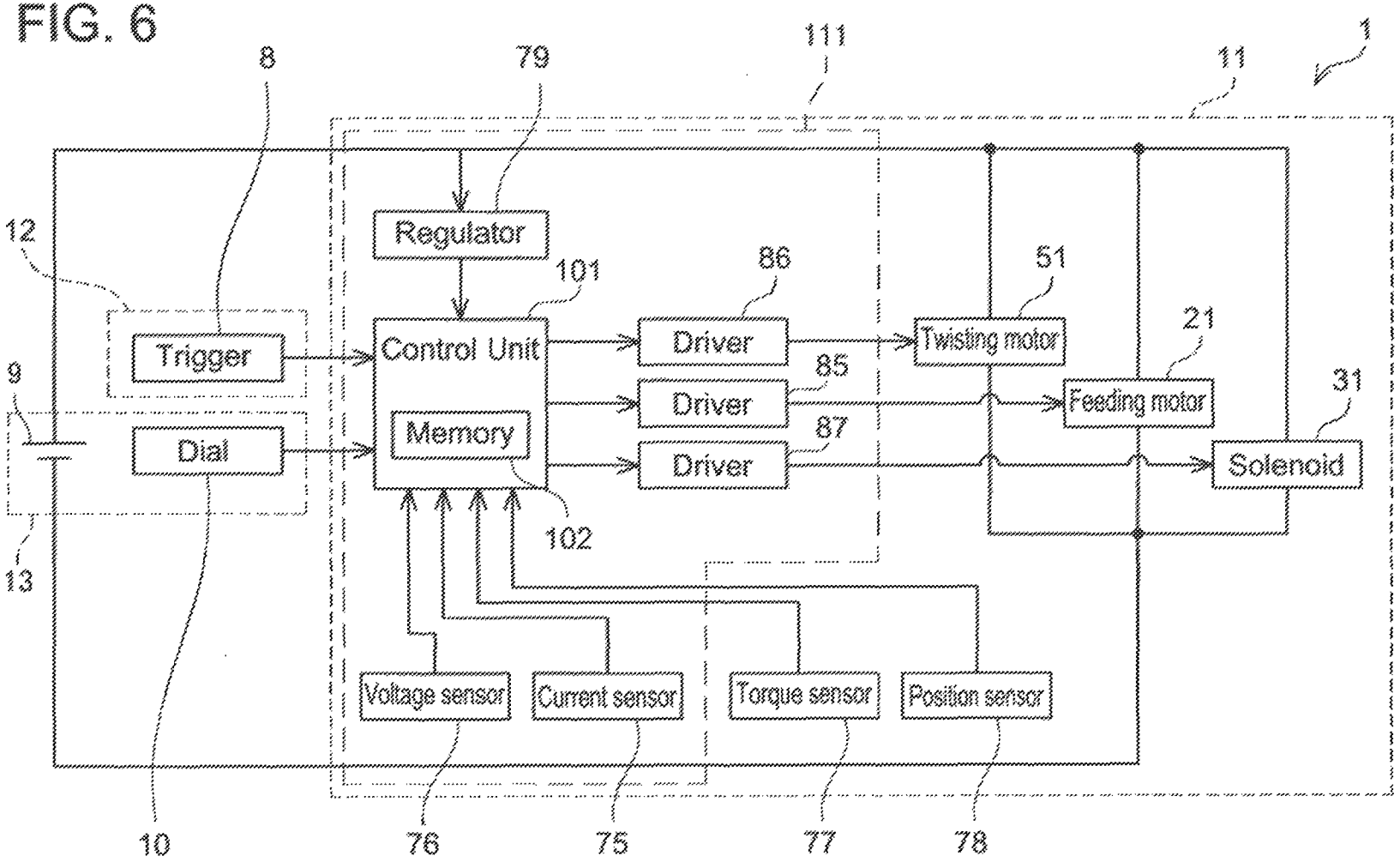
FIG. 6 is a block diagram that illustrates an electrical configuration of the rebar tying device according to the first embodiment.

As shown in FIG. 6, the rebar tying device 1 further includes a control unit 101 (an example of the control unit), a current sensor 75 (an example of the current detector), a voltage sensor 76 (an example of the voltage detector), a torque sensor 77, and a position sensor 78. Moreover, the rebar tying device 1 includes a plurality of drivers 85, 86, and 87, and a regulator 79.

The control unit 101, the current sensor 75, the voltage sensor 76, the torque sensor 77, and the position sensor 78 are arranged in the first unit 11. The control unit 101, the current sensor 75, and the voltage sensor 76 are arranged on a same substrate 111. The substrate 111 is arranged below the feeding motor 21 and the twisting motor 51. The current sensor 75 is configured to detect a current of the feeding motor 21. The torque sensor 77 is configured to detect a torque that acts on the twisting motor 51 when the pair of hooks 54 is rotating. The position sensor 78 is configured to detect a position of the screw tube 53. The voltage sensor 76 is configured to detect a voltage of the battery 9. Each of the current sensor 75, the voltage sensor 76, the torque sensor 77, and the position sensor 78 transmits a signal to the control unit 101.

The plurality of drivers 85, 86, and 87, and the regulator 79 are arranged in the first unit 11. The plurality of drivers 85, 86, and 87, and the regulator 79 are arranged on the same substrate 111. A signal is transmitted from the control unit 101 to the feeding motor 21 via the driver 85. Moreover, a signal is transmitted from the control unit 101 to the twisting motor 51 via the driver 86. Moreover, a signal is transmitted from the control unit portion 101 to the solenoid 31 via the driver 87. Moreover, the regulator 79 adjusts a voltage of the power supplied by the battery 9 and then supplied the power to the control unit 101.

The control unit 101 controls an energizing time of the feeding motor 21 based on a preset feeding length of the wire 301. The control unit 101 controls a feeding length of the wire 301 by controlling the energizing time of the feeding motor 21. An operation of the control unit 101 will be described later in details. The control unit 101 is arranged on a substrate (not shown) in the first unit 11.

The control unit 101 includes a memory 102. The memory 102 stores a program executed by the control unit 101. The memory 102 stores various types of information.

Next, an operation of the rebar tying device 1 will be described. When a user uses the rebar tying device 1, the user initially turns the dial 10 to set the number of turns of the wire 301. Next, the user arranges the rebar tying device 1 with respect to the plurality of rebars 201. Specifically, as shown in FIG. 1, the user grasps the rebar tying device 1 such that the plurality of rebars 201 are positioned in the rebar arrangement region 44. Successively, the user depresses the trigger 8 while grasping the grip 7.

When the trigger 8 is depressed, the wire 301 is fed by the feeder 2, and the fed wire 301 is guided by the guide 4 to around the plurality of rebars 201. The wire 301 is thereby wound around the plurality of rebars 201. The wire 301 fed by the feeder 2 is cut by the cutter 6 at a predetermined position. Moreover, the wire 301 wound around the plurality of rebars 201 is twisted by the twister 5. The plurality of rebars 201 is thereby tied by the wire 301.

Next, the operation of the control unit 101 will be described. When the rebar tying device 1 ties the plurality of rebars 201, the control unit 101 executes the following process based on the program.

Figure 7:
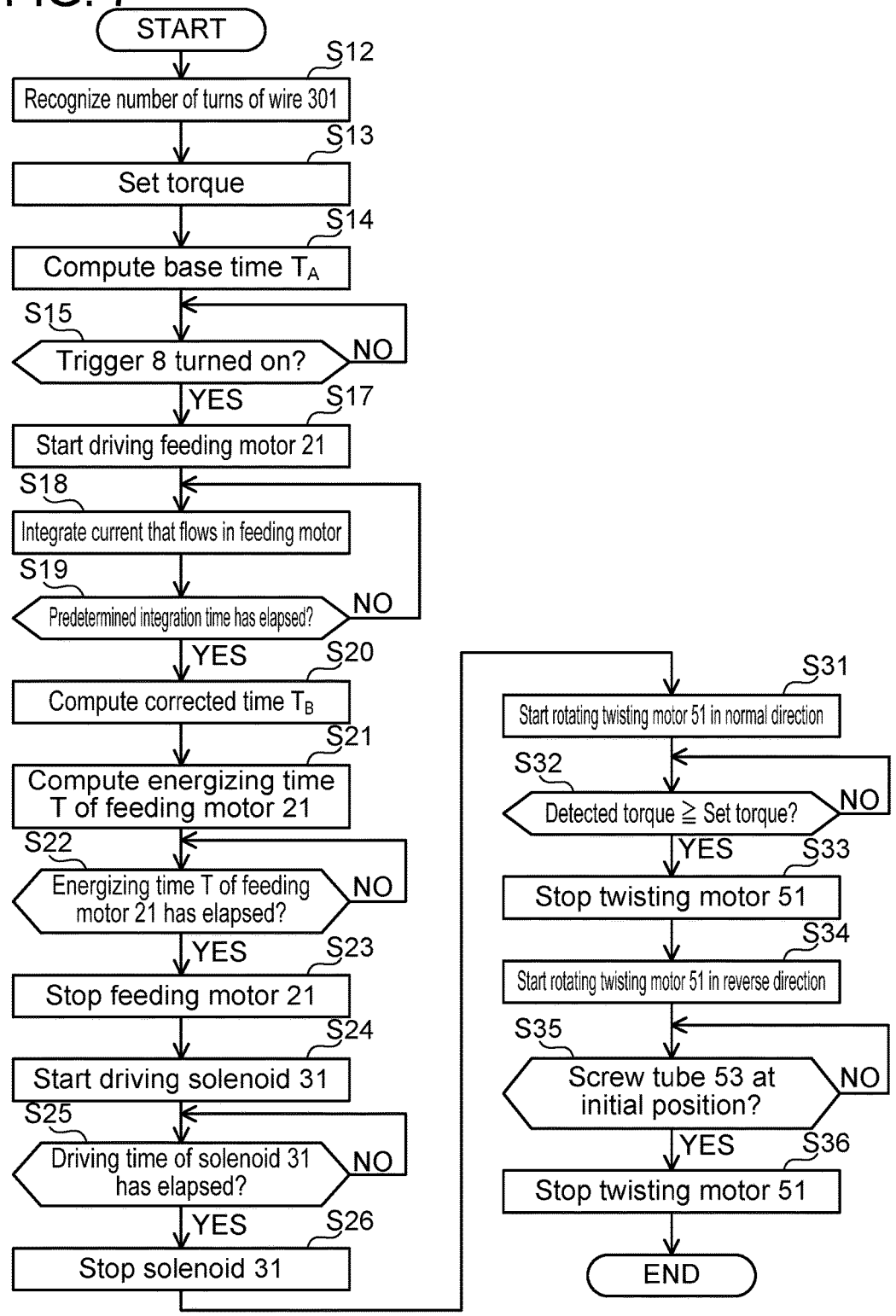
FIG. 7 is a flowchart that illustrates a process by a control unit according to the first embodiment.

When the user sets the number of turns of the wire 301 as described above, the control unit 101 recognizes the set number of turns of the wire 301 in S12 in FIG. 7. The number of turns of the wire 301 determines a feeding length of the wire 301. Moreover, the number of turns of the wire 301 determines a provisional energizing time of the feeding motor 21. This provisional energizing time is corrected in S14 and the following steps mentioned below.

In the next S13, the control unit 101 sets a torque that corresponds to the set number of turns of the wire 301. The set torque is used when the wire 301 wound around the plurality of rebars 201 is twisted.

In the next S14, the control unit 101 computes a base time $T_A$. The base time $T_A$ is computed based on a first coefficient $K_1$ and an open voltage $V_{open}$ of the battery 9. The base time $T_A$ is represented by Equation 1. A higher open voltage $V_{open}$ of the battery 9 causes a shorter base time $T_A$. In contrast to this, a lower open voltage $V_{open}$ of the battery 9 causes a longer base time $T_A$.

[Math. 1]

$$T_A = \frac{K_1}{V_{OPEN}} \quad \text{(Eq. 1)}$$

$T_A$: Base time
$K_1$: First coefficient
$V_{OPEN}$: Open voltage of battery

The first coefficient $K_1$ is preset in accordance with the number of turns of the wire 301, and prestored in the memory 102. The first coefficient $K_1$ is empirically determined in advance. The open voltage $V_{open}$ of the battery 9 refers to a voltage between output terminals of the battery 9 in a state where the feeding motor 21, the solenoid 31, and the twisting motor 51 are not driven, or in a state where no power is supplied from the battery 9 to the feeding motor 21, the solenoid 31, and the twisting motor 51. The open voltage $V_{open}$ of the battery 9 is measured before the feeding motor 21, the solenoid 31, and the twisting motor 51 are driven, and stored in the memory 102. The base time $T_A$ is used for computing the energizing time of the feeding motor 21.

In the next S15, the control unit 101 determines whether or not the trigger 8 is turned on. If the user depresses the trigger 8, the trigger 8 is turned on. If the trigger 8 is turned on in S15, the control unit 101 makes a determination of YES and proceeds to S17. On the other hand, if the trigger 8 is not turned on (is turned off) in S15, the control unit 101 makes a determination of NO and waits.

Figure 8:
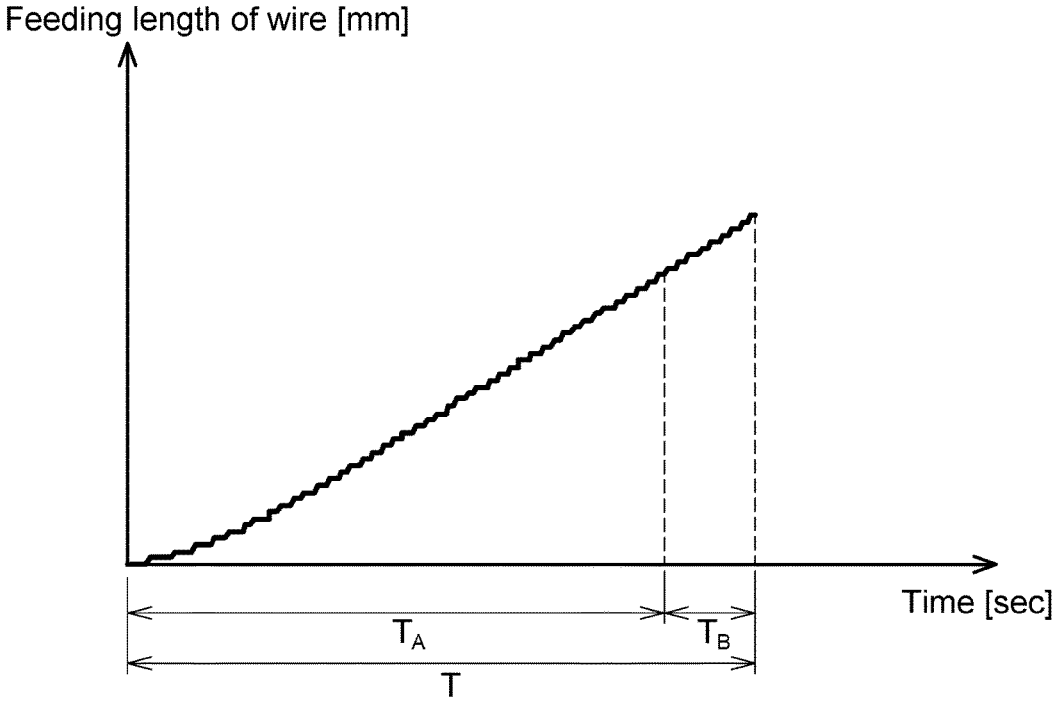
FIG. 8 is a graph that shows a relation between a time from a start of a rotation of a feeding motor and a feeding length of a wire.

In the next S17, the control unit 101 starts driving the feeding motor 21. The feeding motor 21 thereby rotates. When the feeding motor 21 rotates, the driving roller 22 rotates, and the wire 301 wound around the reel 24 is fed. The wire 301 fed by the rotation of the feeding motor 21 is guided by the guide 4 to around the plurality of rebars 201. As shown in FIG. 8, when the feeding motor 21 rotates and the wire 301 is fed, the feeding length of the wire 301 increases with a lapse of time.

Figure 9:
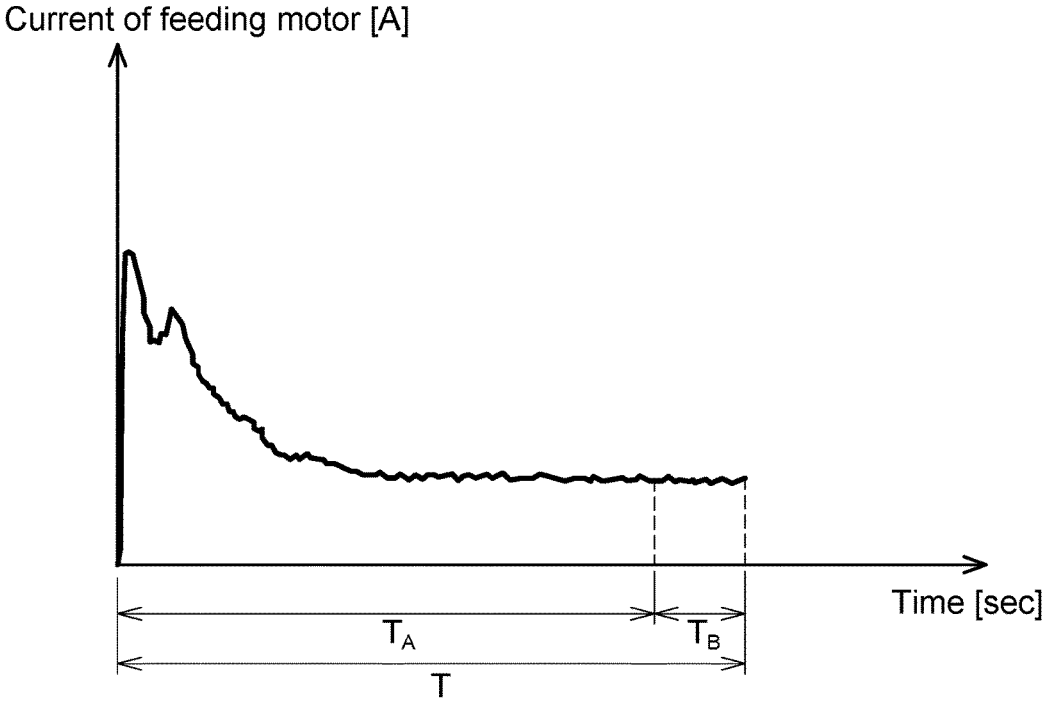
FIG. 9 is a graph that shows a relation between the time from the start of the rotation of the feeding motor and a current of the feeding motor.

Moreover, as shown in FIG. 9, when the feeding motor 21 starts rotating, a current that flows in the feeding motor 21 varies with a lapse of time. The current of the feeding motor 21 is detected by the current sensor 75. Until a certain time has elapsed from the start of the rotation of the feeding motor 21, the feeding motor 21 has a high load imposed thereon in order to start rotating the reel 24 in a stopped state, and the current of the feeding motor 21 becomes unstable and large. In other words, during this period, the rotation of the feeding motor 21 can be said to be unstable. On the other hand, after the certain time has elapsed from the start of the rotation of the feeding motor 21, the reel 24 continues rotating stably, and hence the load imposed on the feeding motor 21 becomes low, and the current of the feeding motor 21 becomes stable and small. In other words, during this period, the rotation of the feeding motor 21 can be said to be stabilized.

Figure 10:
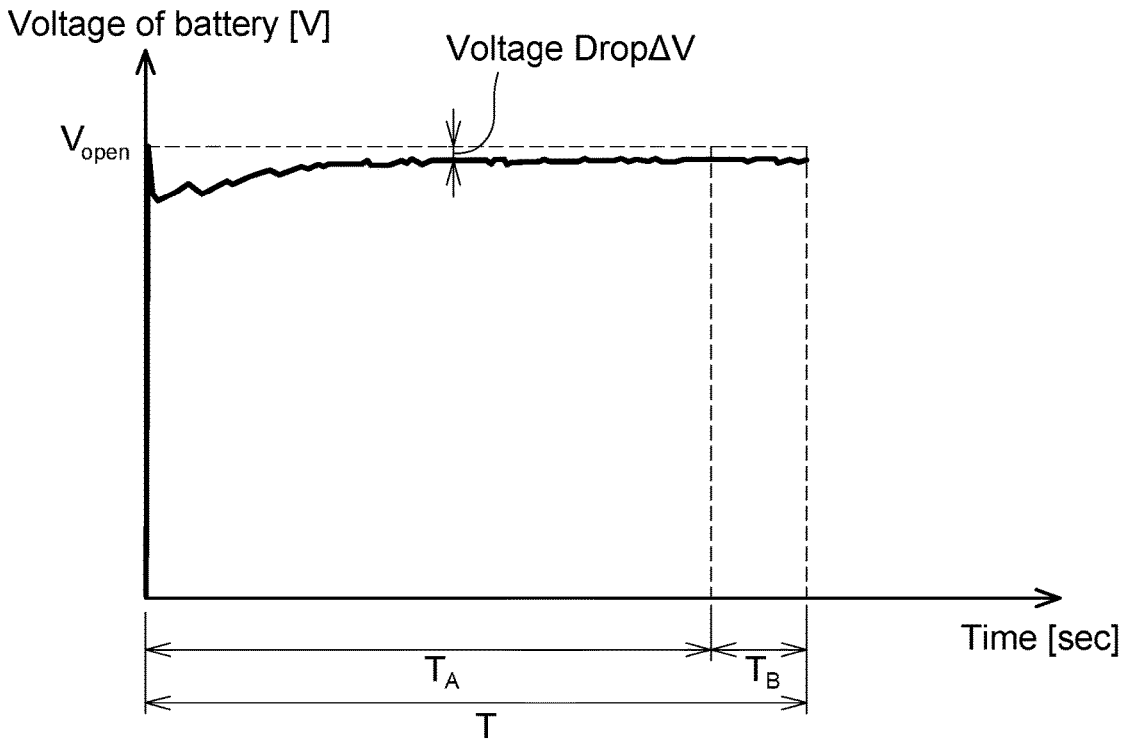
FIG. 10 is a graph that shows a relation between the time from the start of the rotation of the feeding motor and a voltage of a battery.

Moreover, as shown in FIG. 10, when the feeding motor 21 starts rotating, a voltage of the battery 9 varies with a lapse of time. The voltage of the battery 9 is detected by the voltage sensor 76. Until a certain time has elapsed from the start of the rotation of the feeding motor 21, the voltage of the battery 9 is unstable. On the other hand, after the certain time has elapsed from the start of the rotation of the feeding motor 21, the voltage of the battery 9 is stabilized.

When the feeding motor 21 rotates and the wire 301 is fed, the control unit 101 integrates the current that flows in the feeding motor 21 in the next S18 until the rotation of the feeding motor 21 is stabilized from the start of the rotation of the feeding motor 21. In the present embodiment, the control unit 101 integrates the current of the feeding motor 21 for a predetermined integration time after the start of the rotation of the feeding motor 21. The integration time is preset in consideration of a time required for the rotation of the feeding motor 21 to be stabilized. For example, the integration time is set to 0.1 seconds. In S18, a time integration value $I_{sum}$ of the current of the feeding motor 21 is computed.

In the next S19, the control unit 101 determines whether or not the predetermined integration time has elapsed from the start of the rotation of the feeding motor 21. If the predetermined integration time has elapsed in S19, the control unit 101 makes a determination of YES and proceeds to S20. If the predetermined integration time has elapsed, the rotation of the feeding motor 21 has already been stabilized. On the other hand, if the predetermined integration time has not elapsed yet in S19, the control unit 101 makes a determination of NO and returns to S18, and continues integrating the current of the feeding motor 21.

In S20, the control unit 101 computes a corrected time $T_B$. The corrected time $T_B$ is computed based on a second coefficient $K_2$, the time integration value $I_{sum}$ of the current of the feeding motor 21, a current I of the feeding motor 21 when the rotation of the feeding motor 21 is stabilized (i.e., the current I of the feeding motor 21 after the predetermined integration time has elapsed from the start of the rotation of the feeding motor 21), a voltage $V_{max}$ of the battery 9 when the battery 9 is fully charged, and a voltage $V_b$ of the battery 9 when the rotation of the feeding motor 21 is stabilized (i.e., the voltage $V_b$ of the battery 9 after the predetermined integration time has elapsed from the start of the rotation of the feeding motor 21). The corrected time $T_B$ is represented by Equation 2.

[Math. 2]

$$T_B = K_2 \times \frac{I_{sum}}{I} \times \frac{V_{MAX}}{V_b} \quad \text{(Eq. 2)}$$

$T_B$: Corrected time
$K_2$: Second coefficient
$I_{sum}$: Time integration value of current of feeding motor
I: Current of feeding motor when rotation of feeding motor is stabilized
$V_{MAX}$: Voltage of battery when battery is fully charged
$V_b$: Voltage of battery when rotation of feeding motor is stabilized The second coefficient $K_2$ is preset, and prestored in the memory 102. The second coefficient $K_2$ is empirically determined in advance. The voltage $V_{max}$ of the battery 9 when the battery 9 is fully charged is determined in advance for every product, and prestored in the memory 102. The corrected time $T_B$ is used for computing the energizing time of the feeding motor 21.

In the next S21, the control unit 101 computes an energizing time T of the feeding motor 21 based on the base time $T_A$ and the corrected time $T_B$. The energizing time T of the feeding motor 21 is represented by Equation 3.

[Math. 3]

$$T = T_A + T_B \quad \text{(Eq.3)}$$

T: Energizing time of feeding motor

In the next S22, the control unit 101 determines whether or not the energizing time T of the feeding motor 21 computed in S21 has elapsed from the start of the rotation of the feeding motor 21. If the energizing time T of the feeding motor 21 has elapsed in S22, the control unit 101 makes a determination of YES and proceeds to S23. On the other hand, if the energizing time T of the feeding motor 21 has not elapsed in S22, the control unit 101 makes a determination of NO and waits.

In S23, the control unit 101 stops the feeding motor 21. When the feeding motor 21 stops, the driving roller 22 stops and the wire 301 is no longer fed. An operation of feeding the wire 301 is thereby terminated.

In S24, the control unit 101 starts driving the solenoid 31. This causes the solenoid 31 and the rotation-regulating arm 32 to operate. When the rotation-regulating arm 32 operates, the rotation-regulating arm 32 engages with the rotation-regulating protrusion 241 of the reel 24. The rotation of the reel 24 is thereby regulated.

In the next S25, the control unit 101 determines whether or not a driving time of the solenoid 31 (e.g., 45 ms) has elapsed. If the driving time of the solenoid 31 has elapsed in S25, the control unit 101 makes a determination of YES and proceeds to S26. On the other hand, if the driving time of the solenoid 31 has not elapsed in S25, the control unit makes a determination of NO and continues operating.

In S26, the control unit 101 stops the solenoid 31. When the solenoid 31 stops, the rotation-regulating arm 32 and the rotation-regulating protrusion 241 of the reel 24 are disengaged from each other, and the regulation of the rotation of the reel 24 is released.

In the next S31, the control unit 101 starts rotating the twisting motor 51 of the twister 5 in a normal direction. When the twisting motor 51 rotates in the normal direction, the screw shaft 52 rotates in the normal direction, and the screw tube 53 proceeds accordingly.

When the screw tube 53 proceeds, the link mechanism 61 of the cutter 6 converts linear motion to rotational motion, and the cutter portion 62 rotates. When the cutter portion 62 rotates, the wire 301 is cut by the cutter portion 62.

Moreover, when the screw tube 53 proceeds, the pair of hooks 54 proceeds. At a position where the pair of hooks 54 proceeds, the pair of hooks 54 grasps the wire 301 around the plurality of rebars 201. Moreover, while grasping the wire 301, the pair of hooks 54 rotates by a rotation of the screw shaft 52. When the pair of hooks 54 rotates, the wire 301 is twisted. When the wire 301 is twisted, a torque that acts on the screw shaft 52 increases, and a torque of the twisting motor 51 increases. The torque that acts on the twisting motor 51 is detected by the torque sensor 77 detecting the current of the twisting motor 51.

In the next S32, the control unit 101 determines whether or not the torque detected by the torque sensor 77 is equal to or above the torque set in S13 described above. If the detected torque is equal to or above the set torque, the control unit 101 makes a determination of YES in S32 and proceeds to S33. On the other hand, if the detected torque is not equal to or above (is less than) the set torque, the control unit 101 makes a determination of NO in S32 and waits.

In S33, the control unit 101 stops the twisting motor 51.

In the next S34, the control unit 101 starts rotating the twisting motor 51 in a reverse direction. When the twisting motor 51 rotates in the reverse direction, the pair of hooks 54 releases the wire 301 that they grasp. After the pair of hooks 54 releases the wire 301, the screw shaft 52 rotates in a reverse direction, and the screw tube 53 retreats accordingly. The position of the screw tube 53 is detected by the position sensor 78. When the screw tube 53 retreats, the pair of hooks 54 retreats.

In the next S35, the control unit 101 determines whether or not the position of the screw tube 53 detected by the position sensor 78 is an initial position. If the position of the screw tube 53 is the initial position at S35, the control unit 101 makes a determination of YES and proceeds to S36. On the other hand, if the position of the screw tube 53 is not the initial position at S35, the control unit 101 makes a determination of NO and continues operating.

In S36, the control unit 101 stops the twisting motor 51. The twisting operation of the wire 301 is thereby terminated. As described above, the rebar tying device 1 ties the plurality of rebars 201 by the wire 301.

As described above, the configuration and the operation of the rebar tying device 1 in the first embodiment have been described. As is clear from the description above, the rebar tying device 1 in the present embodiment includes the feeder 2 configured to feed the wire 301 wound around the reel 24 by the rotation of the feeding motor 21, the guide 4 configured to guide the wire 301 fed by the feeder 2 to around the plurality of rebars 201, and the cutter 6 configured to cut the wire 301 fed by the feeder 2 at a predetermined position. Moreover, the rebar tying device 1 includes the twister 5 configured to twist the wire 301 around the plurality of rebars 201, the battery 9 configured to supply power to the feeding motor 21, and the control unit 101. Moreover, as shown in Expression 1, the control unit 101 computes the base time $T_A$ based on the first coefficient $K_1$ that corresponds to the number of turns of the wire 301 set by the dial 10. As shown in Equation 3, the control unit 101 then computes the energizing time T of the feeding motor 21 based on the base time $T_A$. Moreover, as shown in FIG. 7, if the computed energizing time T of the feeding motor 21 has elapsed, the control unit 101 stops the feeding motor 21. As such, the control unit 101 controls the feeding length of the wire 301 by controlling the energizing time T of the feeding motor 21 based on the preset feeding length of the wire 301.

According to such a configuration, since the control unit 101 can control the feeding length of the wire 301 by controlling the energizing time T of the feeding motor 21, the control unit 101 can control the feeding length of the wire 301 without using a separate detector to detect the feeding length of the wire 301. Moreover, since the control unit 101 controls the energizing time T of the feeding motor 21 based on the preset feeding length of the wire 301, the wire 301 can be fed by an accurate length.

Moreover, in the embodiment described above, the base time $T_A$ is computed based on the open voltage $V_{open}$ of the battery 9 as shown in Equation 1, and the energizing time T of the feeding motor 21 is computed based on the base time $T_A$ as shown in Expression 3. As such, the energizing time T of the feeding motor 21 is set based on the open voltage $V_{open}$ of the battery 9. The energizing time T of the feeding motor 21 is set based on a state of the rebar tying device 1 before the rotation of the feeding motor 21. The speed of feeding the wire 301 by the feeding motor 21 depends on the open voltage $V_{open}$ of the battery 9, and a higher open voltage $V_{open}$ of the battery 9 causes a higher speed of feeding the wire 301, and hence the energizing time T of the feeding motor 21 needs to be decreased. In contrast to this, a lower open voltage $V_{open}$ of the battery 9 causes a lower speed of feeding the wire 301, and hence the energizing time T of the feeding motor 21 needs to be increased. According to the configuration described above, since the energizing time T of the feeding motor 21 is set based on the open voltage $V_{open}$ of the battery 9, the energizing time T of the feeding motor 21 can be controlled accurately.

Moreover, in the embodiment described above, the corrected time $T_B$ is computed based on the time integration value $I_{sum}$ of the current of the feeding motor 21 as shown in Equation 2, and the energizing time T of the feeding motor 21 is computed based on the corrected time $T_B$ as shown in Equation 3. As such, the energizing time T of the feeding motor 21 is set based on the time integration value $I_{sum}$ of the current of the feeding motor 21 from the start of the rotation of the feeding motor 21. In other words, the energizing time T of the feeding motor 21 is set based on the state of the rebar tying device 1 during the rotation of the feeding motor 21. Moreover, the energizing time T of the feeding motor 21 is set based on the state of the feeding motor 21. The speed of feeding the wire 301 by the feeding motor 21 varies with the remaining amount of the wire 301 wound around the reel 24, and a larger remaining amount of the wire 301 wound around the reel 24 causes a larger moment of inertia of the reel 24, and a lower speed of feeding the wire 301. The remaining amount of the wire 301 wound around the reel 24 can be estimated based on the time integration value $I_{sum}$ of the current of the feeding motor 21 from the start of the rotation of the feeding motor 21. According to the configuration described above, since the energizing time T of the feeding motor 21 is set based on the time integration value $I_{sum}$ of the current of the feeding motor 21 from the start of the rotation of the feeding motor 21, the energizing time T of the feeding motor 21 can be controlled accurately. The corrected time $T_B$ is preferably computed at an early timing after the rotation of the feeding motor 21 is stabilized. A sufficient time for computing the corrected time $T_B$ can thereby be ensured.

Moreover, in the embodiment described above, the corrected time $T_B$ is computed based on the voltage $V_b$ of the battery 9 when the rotation of the feeding motor 21 is stabilized as shown in Equation 2, and the energizing time T of the feeding motor 21 is computed based on the corrected time $T_B$ as shown in Equation 3. In other words, the energizing time T of the feeding motor 21 is set based on the state of the rebar tying device 1 when the rotation of the feeding motor 21 is stabilized. The energizing time T of the feeding motor 21 is set based on the state of the battery 9. The energizing time T of the feeding motor 21 is set based on the voltage $V_b$ of the battery 9 when the rotation of the feeding motor 21 is stabilized. The speed of feeding the wire 301 by the feeding motor 21 varies with the remaining amount of the battery 9, and a larger remaining amount of the battery 9 causes larger power to be supplied to the feeding motor 21, and a higher speed of feeding the wire 301. The remaining amount of the battery 9 can be estimated from the voltage $V_b$ of the battery 9 when the rotation of the feeding motor 21 is stabilized. According to the configuration described above, since the energizing time T of the feeding motor 21 is set based on the voltage $V_b$ of the battery 9 when the rotation of the feeding motor 21 is stabilized, the energizing time T of the feeding motor 21 can be controlled accurately.

Moreover, in the embodiment described above, the rebar tying device 1 includes the dial 10 configured to set the feeding length of the wire 301, and the energizing time T of the feeding motor 21 is set based on the feeding length of the wire 301 set by the dial 10. According to such a configuration, a user of the rebar tying device 1 can set the feeding length of the wire 301 to a desired feeding length.

One embodiment has been described above. However, a specific aspect is not limited to the embodiment described above. It should be noted that, in the following description, a configuration similar to the configuration in the description mentioned above has the same sign attached thereto, and a description thereof will be omitted.

Second Embodiment

Figure 11:
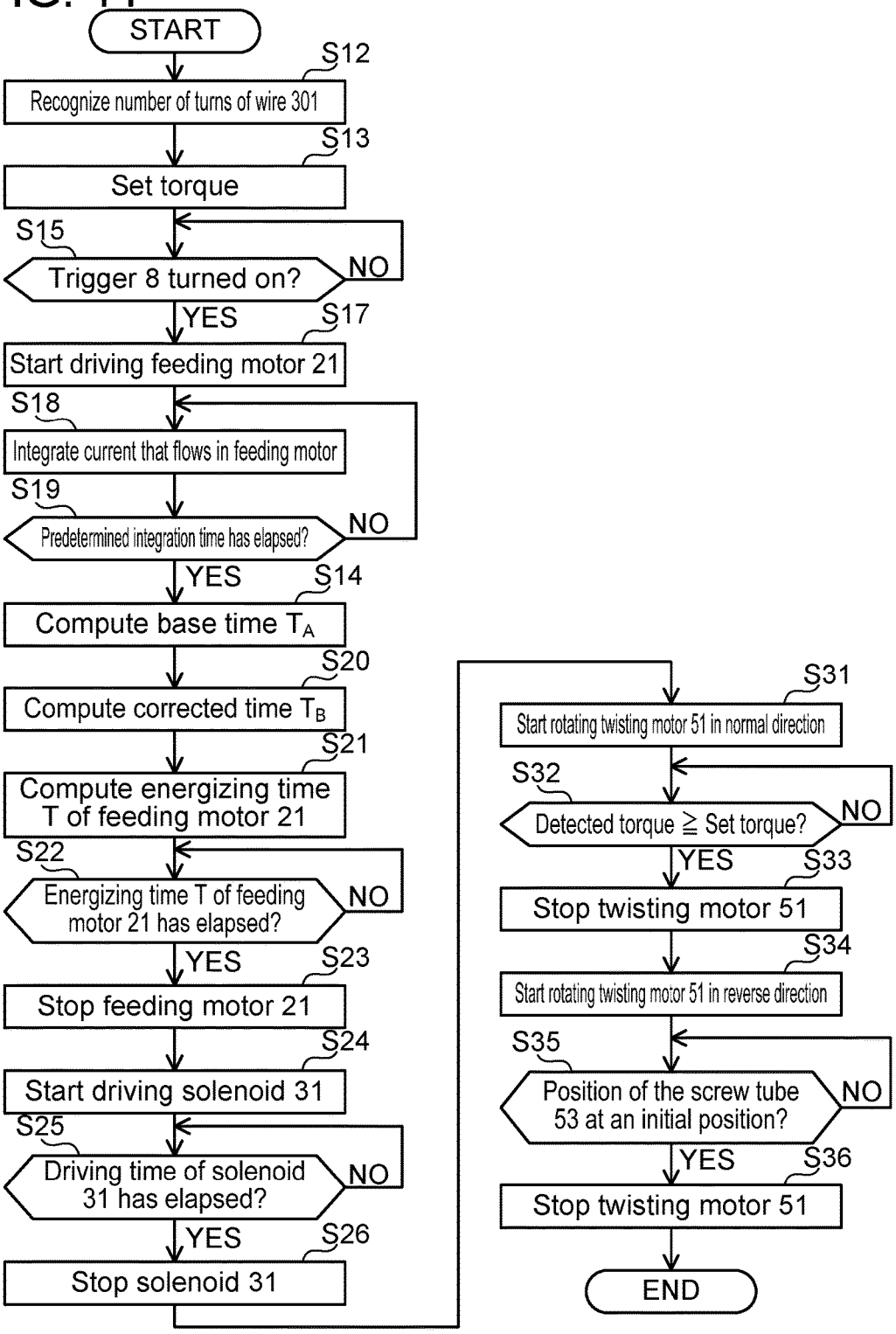
FIG. 11 is a flowchart that illustrates a process by a control unit according to a second embodiment.

In the embodiment described above, the base time $T_A$ is computed based on the open voltage $V_{open}$ of the battery 9 as shown in Equation 1. However, the configuration of the present teachings is not limited thereto. Moreover, in the embodiment described above, the base time $T_A$ is computed before the rotation of the feeding motor 21. However, the configuration of the present teachings is not limited thereto. In a second embodiment, as shown in FIG. 11, the control unit 101 sets a torque in S13, and then proceeds to S15 without computing the base time $T_A$.

Subsequently, when the control unit 101 makes a determination of YES in S19, the control unit 101 proceeds to S14. In S14, the control unit 101 computes the base time $T_A$. The base time $T_A$ is computed during the rotation of the feeding motor 21. The base time $T_A$ is computed as follows. In other words, the control unit 101 initially computes an induced voltage $E_M$ of the feeding motor 21 based on an applied voltage $V_M$ of the feeding motor 21 and a current I of the feeding motor 21 when the rotation of the feeding motor 21 is stabilized (i.e., the applied voltage $V_M$ of the feeding motor 21 and the current I of the feeding motor 21 after a predetermined time has elapsed from the start of the rotation of the feeding motor 21), and a resistance $R_M$ of the feeding motor 21. The induced voltage $E_M$ of the feeding motor 21 is represented by Equation 4. It should be noted that, when the induced voltage $E_M$ of the feeding motor 21 is to be computed, an influence by an inductor of the feeding motor 21 is negligible.

[Math. 4]

$$E_M = V_M - I \times R_M \quad \text{(Eq. 4)}$$

$E_M$: Induced voltage of feeding motor
$V_M$: Applied voltage of feeding motor
I: Current of feeding motor when rotation of feeding motor is stabilized
$R_M$: Resistance of feeding motor Next, the control unit 101 computes a speed SPD of feeding the wire 301 based on a third coefficient $K_3$ and the induced voltage $E_M$ of the feeding motor 21. The speed SPD of feeding the wire 301 can be represented by Equation 5. The third coefficient $K_3$ is empirically determined in advance, and prestored in the memory 102.

[Math. 5]

$$SPD = K_3 \times E_M \quad \text{(Eq.5)}$$

SPD: Speed of feeding wire
$K_3$: Third coefficient
$E_M$: Induced voltage of feeding motor Next, the control unit 101 computes the base time $T_A$ based on a preset feeding length L of the wire 301 and the speed SPD of feeding the wire 301. The base time $T_A$ is represented by Equation 6.

[Math. 6]

$$T_A = \frac{L}{SPD} \quad \text{(Eq. 6)}$$

$T_A$: Base time
SPD: Speed of feeding wire
L: Preset feeding length of wire

The feeding length L of the wire 301 is set in accordance with the number of turns of the wire 301 set by the dial 10. A correspondence between the feeding length L of the wire 301 and the number of turns of the wire 301 is preset, and prestored in the memory 102.

In the second embodiment, as shown in Equations 4 to 6, the base time $T_A$ is computed based on the induced voltage $E_M$ of the feeding motor 21. As shown in Equation 3, the energizing time T of the feeding motor 21 is then computed based on the base time $T_A$ and the corrected time $T_B$. As such, the energizing time T of the feeding motor 21 is set based on the induced voltage $E_M$ of the feeding motor 21 when the rotation of the feeding motor 21 is stabilized. The speed of feeding the wire 301 by the feeding motor 21 is proportional to the induced voltage $E_M$ of the feeding motor 21. Accordingly, if the induced voltage $E_M$ of the feeding motor 21 is low, the speed of feeding the wire 301 is low, and hence the energizing time T of the feeding motor 21 needs to be increased. In contrast to this, if the induced voltage $E_M$ of the feeding motor 21 is high, the speed of feeding the wire 301 is high, and hence the energizing time T of the feeding motor 21 needs to be decreased. According to the configuration described above, since the energizing time T of the feeding motor 21 is set based on the induced voltage $E_M$ of the feeding motor 21 when the rotation of the feeding motor 21 is stabilized, the energizing time T of the feeding motor 21 can be controlled accurately.

Third Embodiment

Figure 12:
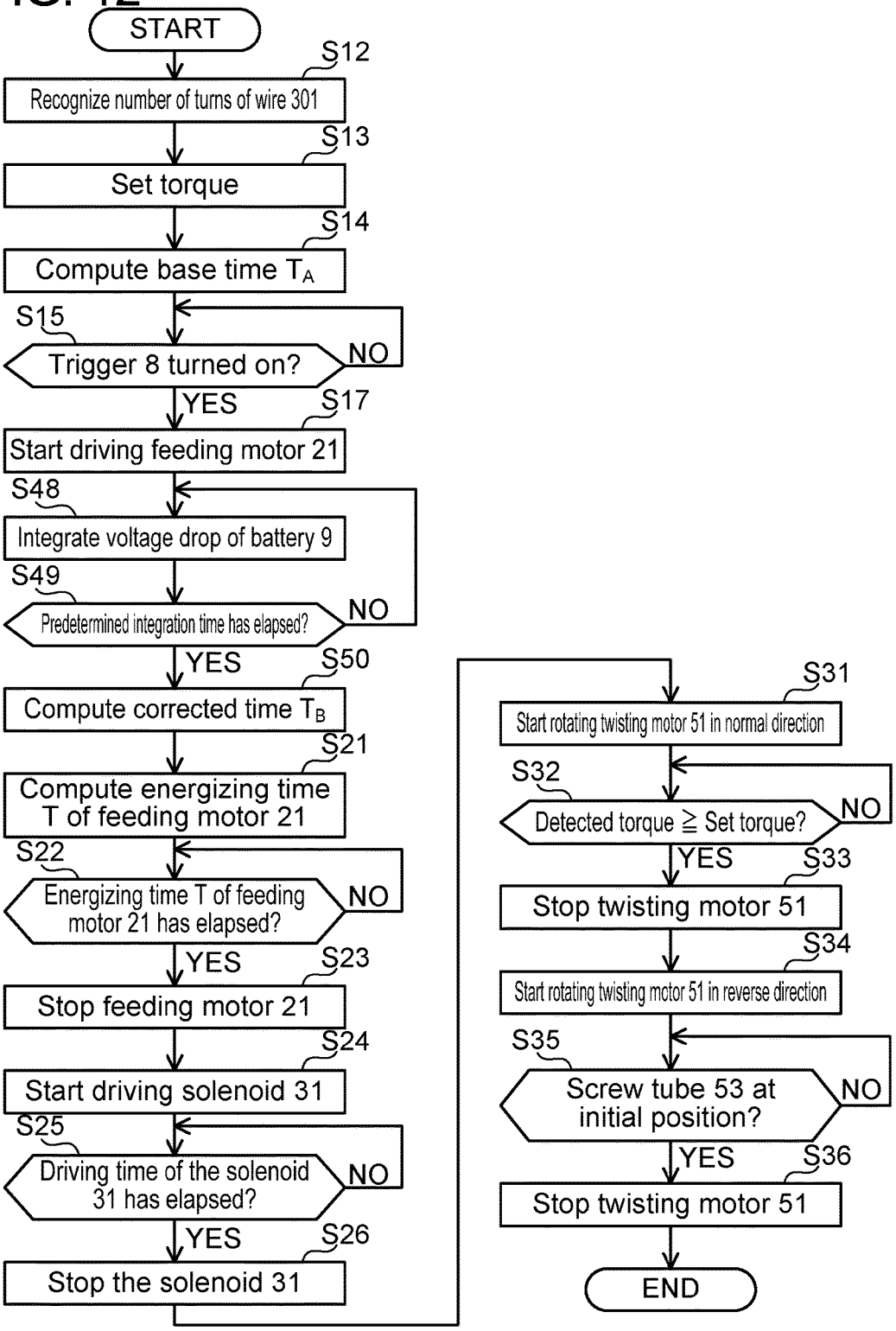
FIG. 12 is a flowchart that illustrates a process by a control unit according to a third embodiment.

Although, in the embodiments described above, the control unit 101 integrates the current of the feeding motor 21 in S18, the configuration of the present teachings is not limited thereto. Moreover, as shown in Equation 2, the corrected time $T_B$ is computed based on the time integration value $I_{sum}$ of the current of the feeding motor 21. However, the configuration of the present teachings is not limited thereto. In a third embodiment, as shown in FIG. 12, after the control unit 101 starts driving the feeding motor 21 in S17, the control unit 101 integrates a voltage drop ΔV of the battery 9 in the next S48 until the rotation of the feeding motor 21 is stabilized from the start of the rotation of the feeding motor 21. In other words, the voltage drop ΔV of the battery 9 is integrated for the predetermined integration time from the start of the rotation of the feeding motor 21. A time integration value $\Delta V_{sum}$ of the voltage drop ΔV of the battery 9 is thereby obtained. The integration time is preset in consideration of a time required for the rotation of the feeding motor 21 to be stabilized. For example, the integration time is set to 0.1 seconds.

The voltage drop ΔV of the battery 9 is a difference between the open voltage $V_{open}$ of the battery 9 and the voltage of the battery 9 when the feeding motor 21 is rotating. In other words, the voltage drop ΔV of the battery 9 is an amount of a voltage drop of the battery 9 from the open voltage $V_{open}$ of the battery 9. As shown in FIG. 10, the voltage drop ΔV of the battery 9 is increasing until a certain time has elapsed from the start of the rotation of the feeding motor 21. On the other hand, the voltage drop ΔV of the battery 9 is decreasing after the certain time has elapsed from the start of the rotation of the feeding motor 21.

In the next S49, the control unit 101 determines whether or not the predetermined integration time has elapsed from the start of the rotation of the feeding motor 21. If the predetermined integration time elapses in S49, the control unit 101 makes a determination of YES and proceeds to S50. If the predetermined integration time has elapsed, the rotation of the feeding motor 21 is stabilized. On the other hand, if the predetermined integration time has not elapsed in S49, the control unit 101 makes a determination of NO and continues integrating the voltage drop ΔV of the battery 9.

In S50, the control unit 101 computes the corrected time $T_B$. The corrected time $T_B$ is computed based on a fourth coefficient $K_4$, the time integration value $\Delta V_{sum}$ of the voltage drop ΔV of the battery 9, the voltage drop ΔV of the battery 9 when the rotation of the feeding motor 21 is stabilized (i.e., the voltage drop ΔV of the battery 9 after the predetermined integration time has elapsed from the start of the rotation of the feeding motor 21), the voltage $V_{max}$ of the battery 9 when the battery 9 is fully charged, and the voltage $V_b$ of the battery 9 when the rotation of the feeding motor 21 is stabilized (i.e., the voltage $V_b$ of the battery 9 after the predetermined integration time has elapsed from the start of the rotation of the feeding motor 21). The corrected time $T_B$ is represented by Equation 7.

[Math. 7]

$$T_B = K_4 \times \frac{\Delta V_{sum}}{\Delta V} \times \frac{V_{MAX}}{V_b} \quad \text{(Eq. 7)}$$

$T_B$: Corrected time
$K_4$: Fourth coefficient
$\Delta V_{sum}$: Time integration value of voltage drop of battery
$\Delta V$: Voltage drop of battery when rotation of the feeding motor is stabilized
$V_{MAX}$: Voltage of battery when battery is fully charged
$V_b$: Voltage of motor after predetermined time has elapsed The fourth coefficient $K_4$ is preset, and prestored in the memory 102. The fourth coefficient $K_4$ is empirically determined in advance.

In the third embodiment, the corrected time $T_B$ is computed based on the time integration value $\Delta V_{sum}$ of the voltage drop $\Delta V$ of the battery 9 as shown in Equation 7, and the energizing time T of the feeding motor 21 is computed based on the corrected time $T_B$ as shown in Equation 3. As such, the energizing time T of the feeding motor 21 is set based on the time integration value $\Delta V_{sum}$ of the voltage drop $\Delta V$ of the battery 9 from the start of the rotation of the feeding motor 21. The speed of feeding the wire 301 by the feeding motor 21 varies with the remaining amount of the wire 301 wound around the reel 24, and a larger remaining amount of the wire 301 wound around the reel 24 causes a larger moment of inertia of the reel 24 and a lower speed of feeding the wire 301. The remaining amount of the wire 301 wound around the reel 24 can be estimated based on the time integration value $\Delta V_{sum}$ of the voltage drop $\Delta V$ of the battery 9 from the start of the rotation of the feeding motor 21. According to the configuration described above, since the energizing time T of the feeding motor 21 is set based on the time integration value $\Delta V_{sum}$, of the voltage drop $\Delta V$ of the feeding motor 21 from the start of the rotation of the feeding motor 21, the energizing time T of the feeding motor 21 can be controlled accurately.

Moreover, a specific aspect is not limited to the embodiment described above. In the embodiment described above, the base time $T_A$ is computed based on Expression 1. However, computing the base time $T_A$ is not limited to this configuration. For example, the base time $T_A$ may be configured to vary stepwisely with the open voltage $V_{open}$ of the battery 9. For example, if the open voltage $V_{open}$ of the battery 9 is equal to or above a predetermined threshold value, the base time $T_A$ may be set as follows: $T_A=T_{A1}$ (a constant), and if the open voltage $V_{open}$ of the battery 9 is less than the predetermined threshold value, the base time $T_A$ may be set as follows: $T_A=T_{A2}$ (a constant). It should be noted that, $T_{A1}<T_{A2}$. With such a configuration as well, the base time $T_A$ in the energizing time T of the feeding motor 21 can be set based on the open voltage $V_{open}$ of the battery 9.

Moreover, in the embodiments described above, the corrected time $T_B$ is computed based on Equations 2 or 7. However, computing the corrected time $T_B$ is not limited to this configuration. For example, the corrected time $T_B$ may also be configured to vary stepwisely with the time integration value $I_{sum}$ of the current of the feeding motor 21. Alternatively, the corrected time $T_B$ may also be configured to vary stepwisely with the time integration value $\Delta V_{sum}$ of the voltage drop $\Delta V$ of the battery 9. Alternatively, the corrected time $T_B$ may also be configured to vary stepwisely with the voltage $V_b$ of the battery 9 when the rotation of the feeding motor 21 is stabilized.

For example, if the time integration value $I_{sum}$ of the current of the feeding motor 21 is equal to or above a predetermined threshold value, the corrected time $T_B$ may be set as follows: $T_B=T_{B1}$ (a constant), and if the time integration value $I_{sum}$ of the current of the feeding motor 21 is less than the predetermined threshold value, the corrected time $T_B$ may be set as follows: $T_B=T_{B2}$ (a constant). It should be noted that, $T_{B1}>T_{B2}$. With such a configuration as well, the corrected time $T_B$ in the energizing time T of the feeding motor 21 can be set based on the time integration value $I_{sum}$ of the current of the feeding motor 21.

Alternatively, if the time integration value $\Delta V_{sum}$ of the voltage drop $\Delta V$ of the battery 9 is equal to or above a predetermined threshold value, the corrected time $T_B$ may be set as follows: $T_B=T_{B3}$ (a constant), and if the time integration value $\Delta V_{sum}$ of the voltage drop $\Delta V$ of the battery 9 is less than the predetermined threshold value, the corrected time $T_B$ may be set as follows: $T_B=T_{B4}$ (a constant). It should be noted that, $T_{B3}>T_{B4}$. With such a configuration as well, the corrected time $T_B$ in the energizing time T of the feeding motor 21 can be set based on the time integration value $\Delta V_{sum}$ of the voltage drop $\Delta V$ of the battery 9.

Alternatively, if the voltage $V_b$ of the battery 9 when the rotation of the feeding motor 21 is stabilized is equal to or above a predetermined threshold value, the corrected time $T_B$ may be set as follows: $T_B=T_BS$ (a constant), and if the voltage $V_b$ of the battery 9 when the rotation of the feeding motor 21 is stabilized is less than the predetermined threshold value, the corrected time $T_B$ may be set as follows: $T_B=T_{B6}$ (a constant). It should be noted that, $T_{B5}<T_{B6}$. With such a configuration as well, the corrected time $T_B$ in the energizing time T of the feeding motor 21 can be set based on the voltage $V_b$ of the battery 9 when the rotation of the feeding motor 21 is stabilized.

Moreover, in the embodiments described above, the control unit 101 is arranged on the substrate 1 in the first unit 11. However, the position of the control unit 101 is not particularly limited. For example, the control unit 101 may also be arranged on a substrate in the second unit 12 or a substrate in the third unit 13 (both of them are not shown). Moreover, a function of the control unit 101 may be provided in a distributed manner to a plurality of substrates.

Moreover, although in the embodiments described above, the torque sensor 77 is configured to detect a torque that acts on the twisting motor 51, the configuration of the present disclosure is not limited thereto. In another embodiment, the current sensor 75 may be configured to detect a current of the twisting motor 51, in addition to a current of the feeding motor 21. The current sensor 75 is configured to detect the torque that acts on the twisting motor 51 by detecting the current of the twisting motor 51.

Specific examples of the present invention have been described in detail, however, these are mere exemplary indications and thus do not limit the scope of the claims. The art described in the claims includes modifications and variations of the specific examples presented above. Technical features described in the description and the drawings may technically be useful alone or in various combinations, and are not limited to the combinations as originally claimed. Further, the art described in the description and the drawings may concurrently achieve a plurality of aims, and technical significance thereof resides in achieving any one of such aims.

REFERENCE SIGNS LIST

1: rebar tying device, 2: feeder, 3: rotation regulator, 4: guide, 5: twister, 6: cutter, 7: grip, 8: trigger, 9: battery, 10:

dial, 11: first unit, 12: second unit, 13: third unit, 21: feeding motor, 22: driving roller, 23: driven roller, 24: reel, 31: solenoid, 32: rotation-regulating arm, 41: guide pipe, 42: upper guide member, 43: lower guide member, 44: rebar arrangement region, 51: twisting motor, 52: screw shaft, 53: screw tube, 54: hook, 61: link mechanism, 62: cutter portion, 75: current sensor, 76: voltage sensor, 77: torque sensor, 78: position sensor, 79: regulator, 85: driver, 86: driver, 87: driver, 101: control unit, 102: memory, 111: substrate, 112: substrate, 201: rebar, 241: rotation-regulating protrusion, 301: wire.

The invention claimed is:

1. A rebar tying device that ties a plurality of rebars by a wire, the device comprising:

a feeder that feeds the wire wound around a reel by a rotation of a feeding motor;

a guide that guides the wire fed by the feeder around the plurality of rebars;

a cutter that cuts the wire fed by the feeder;

a twister that twists the wire around the plurality of rebars;

a battery that supplies power to the feeding motor;

a control unit including a memory; and a current detector that detects a current of the feeding motor, wherein the memory stores a program executed by the control unit to cause the control unit to:

determine an energizing time of the feeding motor based on a time integration value of the current of the feeding motor during rotation of the feeding motor, and control a feeding length of the wire by energizing the feeding motor for the determined energizing time.

2. The rebar tying device according to claim 1, wherein the program stored in the memory causes the control unit to:

integrate a value of the current of the feeding motor over time during the rotation of the feeding motor to determine a time integration value of the current of the feeding motor during the rotation of the feeding motor, determine an energizing time of the feeding motor based on the determined time integration value of the current of the feeding motor during the rotation of the feeding motor.

3. The rebar tying device according to claim 1, further comprising:

a voltage detector that detects a voltage of the battery, wherein the program stored in the memory causes the control unit to determine the energizing time of the feeding motor based on an open voltage of the battery detected by the voltage detector before the rotation of the feeding motor.

4. A rebar tying device that ties a plurality of rebars by a wire, the device comprising:

a feeder that feeds the wire wound around a reel by a rotation of a feeding motor;

a guide that guides the wire fed by the feeder around the plurality of rebars;

a cutter that cuts the wire fed by the feeder;

a twister that twists the wire around the plurality of rebars;

a battery that supplies power to the feeding motor;

a control unit including a memory; and a voltage detector that detects a voltage of the battery, wherein the memory stores a program executed by the control unit to cause the control unit to:

determine an energizing time of the feeding motor based on the voltage of the battery detected by the voltage detector during the rotation of the feeding motor, and control a feeding length of the wire by energizing the feeding motor for the determined energizing time.

5. The rebar tying device according to claim 4, wherein the program stored in the memory causes the control unit to:

determine a voltage drop of the battery based on an open voltage of the battery detected by the voltage detector before the rotation of the feeding motor and the voltage of the battery detected by the voltage detector during the rotation of the feeding motor, integrate the determined voltage drop of the battery over time to determine a time integration value of the voltage drop of the battery during the rotation of the feeding motor, determine an energizing time of the feeding motor based on the determined time integration value of the voltage drop of the battery during the rotation of the feeding motor.

6. The rebar tying device according to claim 4, wherein the program stored in the memory causes the control unit to determine the energizing time of the feeding motor based on an open voltage of the battery detected by the voltage detector before the rotation of the feeding motor.

7. A rebar tying device that ties a plurality of rebars by a wire, the device comprising:

a feeder that feeds the wire wound around a reel by a rotation of a feeding motor;

a guide that guides the wire fed by the feeder around the plurality of rebars;

a cutter that cuts the wire fed by the feeder;

a twister that twists the wire around the plurality of rebars;

a battery that supplies power to the feeding motor; and a control unit including a memory, wherein the memory stores a program executed by the control unit to cause the control unit to:

determine an energizing time of the feeding motor during rotation of the feeding motor based on a predetermined length of wire and based on an induced voltage of the feeding motor during the rotation of the feeding motor, and control a feeding length of the wire by energizing the feeding motor for the determined energizing time.

8. The rebar tying device according to claim 7, further comprising:

a setter that sets the predetermined length of wire.

9. The rebar tying device according to claim 8, wherein the program stored in the memory causes the control unit to:

integrate a value of the current of the feeding motor over time during the rotation of the feeding motor to determine a time integration value of the current of the feeding motor during the rotation of the feeding motor, and determine the energizing time of the feeding motor based on the determined time integration value of the current of the feeding motor during the rotation of the feeding motor.

10. The rebar tying device according to claim 8, further comprising:

a voltage detector that detects a voltage of the battery, wherein the program stored in the memory causes the control unit to:

determine a voltage drop of the battery based on an open voltage of the battery detected by the voltage detector before the rotation of the feeding motor and the voltage of the battery detected by the voltage detector during the rotation of the feeding motor, integrate the determined voltage drop of the battery over time to determine a time integration value of the voltage drop of the battery during the rotation of the feeding motor, and determine the energizing time of the feeding motor based on the determined time integration value of the voltage drop of the battery during the rotation of the feeding motor.

11. The rebar tying device according to claim 7, wherein the program stored in the memory causes the control unit to:

integrate a value of a current of the feeding motor over time during the rotation of the feeding motor to determine a time integration value of the current of the feeding motor during the rotation of the feeding motor, and determine the energizing time of the feeding motor during the rotation of the feeding motor based on the predetermined length of wire, the induced voltage of the feeding motor, and the determined time integration value of the current of the feeding motor.

12. The rebar tying device according to claim 7, further comprising:

a voltage detector that detects a voltage of the battery, wherein the program stored in the memory causes the control unit to:

determine a voltage drop of the battery based on an open voltage of the battery detected by the voltage detector before the rotation of the feeding motor and the voltage of the battery detected by the voltage detector during the rotation of the feeding motor, integrate the determined voltage drop of the battery over time to determine a time integration value of the voltage drop of the battery during the rotation of the feeding motor, and determine the energizing time of the feeding motor during the rotation of the feeding motor based on the predetermined length of wire, the induced voltage of the feeding motor, and the determined time integration value of the voltage drop of the battery.

13. The rebar tying device according to claim 12, wherein the voltage detector and the control unit are arranged on a same substrate.

14. The rebar tying device according to claim 7, further comprising:

a current detector that detects a current of the feeding motor, wherein the program stored in the memory causes the control unit to:

determine an induced voltage of the feeding motor during rotation of the feeding motor based on the current of the feeding motor detected by the current detector during rotation of the feeding motor, and determine an energizing time of the feeding motor based on a predetermined length of wire and based on the determined induced voltage of the feeding motor during the rotation of the feeding motor.

15. The rebar tying device according to claim 14, wherein the current detector and the control unit are arranged on a same substrate.

* * * * *